US005336968A

United States Patent [19]

Strok et al.

[11] Patent Number: 5,336,968

[45] Date of Patent: Aug. 9, 1994

[54] DC OPERATED SODIUM VAPOR LAMP

[75] Inventors: Jack M. Strok, Garrettsville; Rolf S. Bergman, Cleveland Heights; John H. Ingold, Bratenahl, all of Ohio

[73] Assignee: General Electric Company, Schenectady, N.Y.

[21] Appl. No.: 906,802

[22] Filed: Jun. 30, 1992

[51] Int. Cl.[5] ..... H01J 61/22; H01J 61/34

[52] U.S. Cl. ..... 313/571; 313/636; 313/642; 313/25

[58] Field of Search ..... 313/571, 572, 568, 642, 313/625, 636, 25, 639

[56] References Cited

U.S. PATENT DOCUMENTS

| | | | |
|---|---|---|---|
| 3,026,210 | 3/1962 | Coble | 313/636 X |
| 3,117,248 | 1/1964 | Lake | 313/577 |
| 3,384,798 | 5/1968 | Schmidt | 313/571 X |
| 3,453,477 | 7/1969 | Henneman et al. | 313/571 X |
| 3,617,792 | 11/1971 | Lake | 313/573 X |
| 4,567,396 | 1/1986 | McVey | 313/571 X |
| 4,639,639 | 1/1987 | Hirayama et al. | 313/573 X |
| 4,698,549 | 10/1987 | Hammer et al. | 313/565 X |
| 4,868,457 | 9/1987 | Stork | 313/565 X |

*Primary Examiner*—Donald J. Yusko
*Assistant Examiner*—Ashok Patel
*Attorney, Agent, or Firm*—Edward M. Corcoran; George E. Hawranko; Stanley C. Corwin

[57] ABSTRACT

An alkali metal vapor arc discharge lamp which operates on DC and employs an amalgam of mercury and an alkali metal such as sodium, has a cathode to anode pressure ratio no greater than 5 and a cathode end temperature at least 50° C. hotter than the anode end temperature to prevent cataphoretic separation of the mercury and alkali metal in the arc discharge during operation of the lamp. The lamp is designed to have a cataphoretic driving parameter (CDP) value of less than 150. The CDP is defined as the product of the arc current in amperes, times the arc gap length in centimeters, divided by square of the inner diameter of the arc tube in centimeters.

15 Claims, 4 Drawing Sheets

DC OPERATED SODIUM VAPOR LAMP

BACKGROUND OF THE INVENTION

1. Field of the Invention

This invention relates to a DC operated alkali metal vapor arc discharge lamp. More particularly, this invention relates to a DC operated sodium vapor arc discharge lamp comprising an elongated cylindrical arc tube having an electrode sealed in each end to form a cathode end and an anode end and containing a sodium amalgam and a noble starting gas, with the temperature at the cathode end at least 50° C. greater than the temperature at the anode end and a cathode to anode sodium pressure ratio no greater than 5 during operation.

2. Background of the Disclosure

High intensity alkali metal vapor arc discharge lamps, such as high pressure sodium (HPS) arc discharge lamps are widely used for outdoor lighting because of their high efficacy as measured in lumens per watt. However, lighting systems employing HPS lamps often exhibit noticeable buzzing, light flicker and stroboscopic effects during operation from AC sources which can be annoying to the observer. This is especially noticeable with a standard 50–60 Hz line source. There are some specialized applications where only DC power is available such as in mines or on heavy equipment. DC operation of such lamps, particularly on steady DC, will avoid the flickering problem but create other problems associated with cataphoresis. Those skilled in the art know that cataphoresis is a problem with any continuous DC operated lamp having multi-component vapors and in the case of an arc discharge lamp containing alkali metal vapor and mercury or noble gas, exhibits itself as a higher concentration of the alkali metal at the cathode or negative end of the arc tube or chamber due to the unidirectional force toward the cathode that the electric field exerts on the alkali metal ions. Thus, the alkali metal partial pressure at the cathode end of the arc tube is greater than that at the anode end. This results in a difference in both the color and intensity of the emitted light along the length of the arc tube and is more noticeable with longer and narrower arc tubes. This does not normally occur in AC operation wherein the alkali metal pressure is fairly uniform or constant along the length of the arc tube.

The cataphoresis phenomenon also occurs with low pressure metal vapor arc discharge lamps, such as fluorescent lamps which use mercury vapor and a noble gas in the light-emitting arc discharge. Some attempts have been made to overcome cataphoresis in DC operated fluorescent lamps. U.S. Pat. No. 3,117,248 discloses a feedback tube between the anode and cathode ends of the lamps and also suggests counteracting cataphoresis by increasing the wall temperature or current density. In U.S. Pat. No. 3,617,792 a highly loaded and unsealed glass tube inside a fluorescent lamp envelope is employed to counteract cataphoresis. U.S. Pat. No. 4,698,549 discloses the use of an indium amalgam behind the anode in order to maintain a more even mercury distribution in a DC operated fluorescent lamp, but this will not work with an alkali metal vapor arc discharge lamp such as an HPS lamp. Moreover, it is not practical to use a feedback tube between anode and cathode ends for an HPS lamp nor is it practical to use an unsealed tube inside the arc tube to counteract for cataphoresis in such lamps. Hence, there is a need for a DC operated, high intensity alkali metal vapor arc discharge lamp and particularly one having an efficacy proximate that of an AC operated lamp of the same wattage.

SUMMARY OF THE INVENTION

The present invention relates to a DC operated alkali metal vapor arc discharge lamp, such as a high pressure sodium (HPS) vapor lamp which comprises a linear, light transmissive arc chamber having a cathode at one end and an anode at the other end and containing an alkali metal amalgam and a starting gas, with the temperature at the cathode end at least 50° C. and preferably at least 60° C. higher than the anode end and a cathode to anode alkali metal vapor pressure ratio of no greater than 5 during operation of said lamp. The amalgam is an amalgam of alkali metal and mercury and preferably an amalgam which contains at least 20 wt. % of alkali metal. Any amalgam present in excess of the amount vaporized during lamp operation will be located behind the tip of the anode. The arc chamber or tube is made of a suitable ceramic such as alumina. In a preferred embodiment the cataphoretic driving parameter (CDP) will have a value of less than 150 and preferably less than 130. The CDP is the product of the arc current in amperes (I), times the arc gap length in centimeters (G), divided by the square of the inner diameter (B) of the arc tube in centimeters, or $IG/B^2$.

BRIEF DESCRIPTION OF THE DRAWINGS

FIG. 1(*b*) schematically illustrates the cathode end of an arc tube useful in the practice of the invention.

FIG. 1(*c*) schematically illustrates the anode end of an arc tube useful in the practice of the invention.

DETAILED DESCRIPTION

Figure 1A:
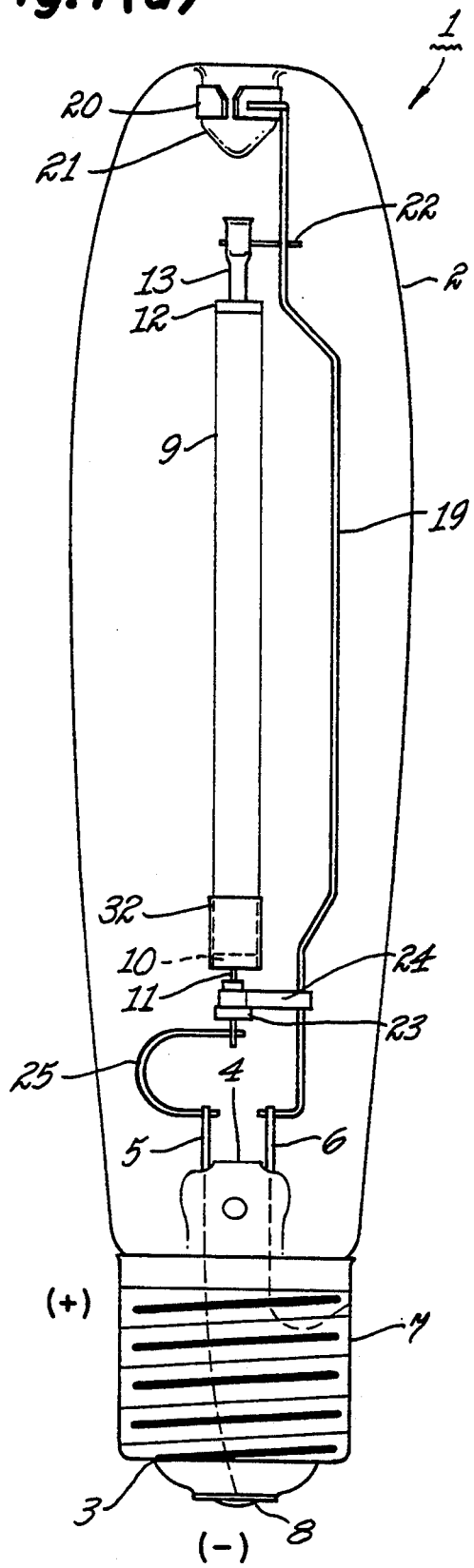
FIG. 1(*a*) schematically illustrates an HPS lamp useful in the practice of the invention.
Figure 1C:
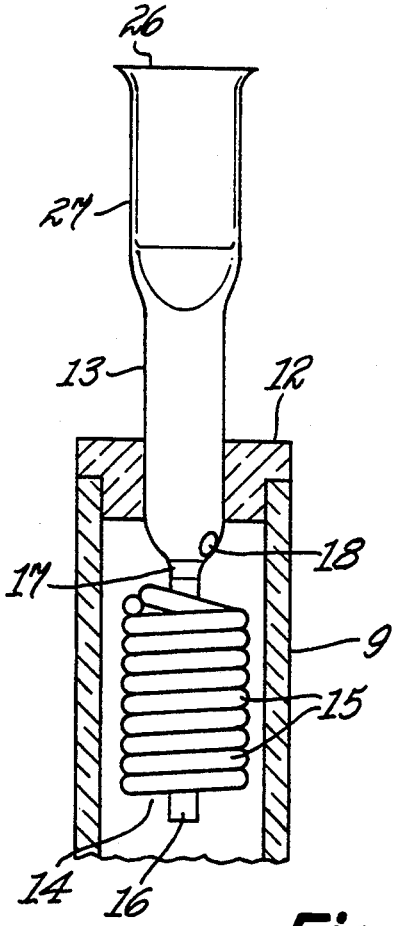
Figure 1B:
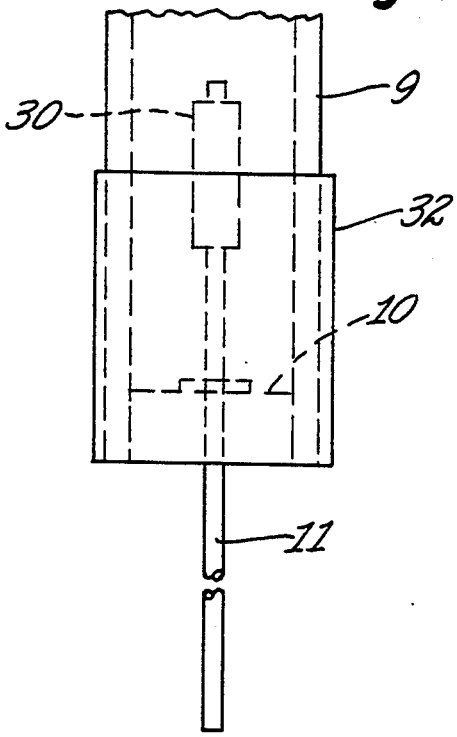

Turning to FIG. 1(*a*), an HPS lamp 1 useful in the practice of the invention is schematically illustrated as comprising a vitreous outer envelope 2 with a standard mogul screw base 3 attached to the stem end. A reentrant stem 4 has a pair of lead-in conductors 5 and 6 extending through it the outer ends of which are connected to the screw shell 7 and eyelet 8 of the base as a means of supplying electricity to the lamp. Arc tube or chamber 9 is a hollow tube of a light-transmitting ceramic tubing such as polycrystalline alumina which is translucent to light. Single crystal alumina, such as sapphire which is clear and transparent, may also be used. The cathode end of the arc chamber is closed by an alumina ceramic plug 10 through which extends niobium inlead wire 11 hermetically sealed in plug 10 for supporting the cathode 30 illustrated in FIG. 1(*b*). The anode end of arc tube 9 illustrated in FIG. 1(*c*) includes a ceramic plug 12 through which extends a thin-walled niobium tube 13 hermetically sealed into plug 12. The niobium tube 13 serves as an exhaust and fill tubulation during manufacture of the lamp, as a current inlead, as an external reservoir for excess sodium-mercury amalgam in the finished lamp, and as a support for anode 14. Tube 13 is hermetically pinch sealed at 26 which is the coldest portion of the overall arc chamber space. Flattened portion 27 is a capillary reservoir for excess amalgam external to arc tube 9. A sealing composition such as a mixture of alumina and calcia well known to those skilled in the art, is used to seal the ceramic end plugs 10 and 12 to the anode and cathode ends, respectively, of arc chamber 9 and also to seal niobium conductors 11 and 13 through the plugs. FIG. 1(*c*) illustrates anode 14 which comprises tungsten wire 15 wound on a tungsten shank 16 in two layers. The shank is seized in the inwardly projecting end of niobium tube 13 either by crimping or by welding at 17; an aperture 18 allows passage of sodium-mercury amalgam vapor from the exhaust tube into the arc chamber or cavity of the arc tube 9. The electrodes are normally activated by alkaline earth metal compounds such as dibarium-calcium tungstate, retained in the interstices between turns of the coiling of the tungsten wire 15. In FIG. 1(*b*) the cathode end of the arc tube is illustrated as including niobium inlead wire 11 supporting cathode 30 which is similar in construction to anode 14. Niobium metal foil 32 is shown wrapped around the cathode end of the arc chamber as one means by which it is possible to increase the temperature at the cathode end in order to assist in achieving the temperature differential of at least 50° C. required to avoid amalgam condensation at the cathode end during operation of the lamp.

Arc tube 9 is mounted within outer envelope 2 by support rod 19 which extends the length of the outer envelope and is welded at one end to lead-in conductor 6 at the stem end with the other end braced by spring clamp 20 engaging dimple 21 in the dome end of the outer envelope 2. Conductor 22 is welded to niobium tube 13 and support rod 19 at the anode end of the arc tube. At the cathode end of the arc tube, axial lead wire 11 extends through an insulating bushing 23 which is supported from rod 19 by means of metal strap 24. The aperture through the bushing allows free axial movement of inlead 11 and a flexible conductor 25 makes the electrical connection from the inlead to lead-in conductor 5. Differential thermal expansion is accommodated by axial movement of inlead 11 through bushing 23 and by flexing of curving conductor 25.

Figure 2:
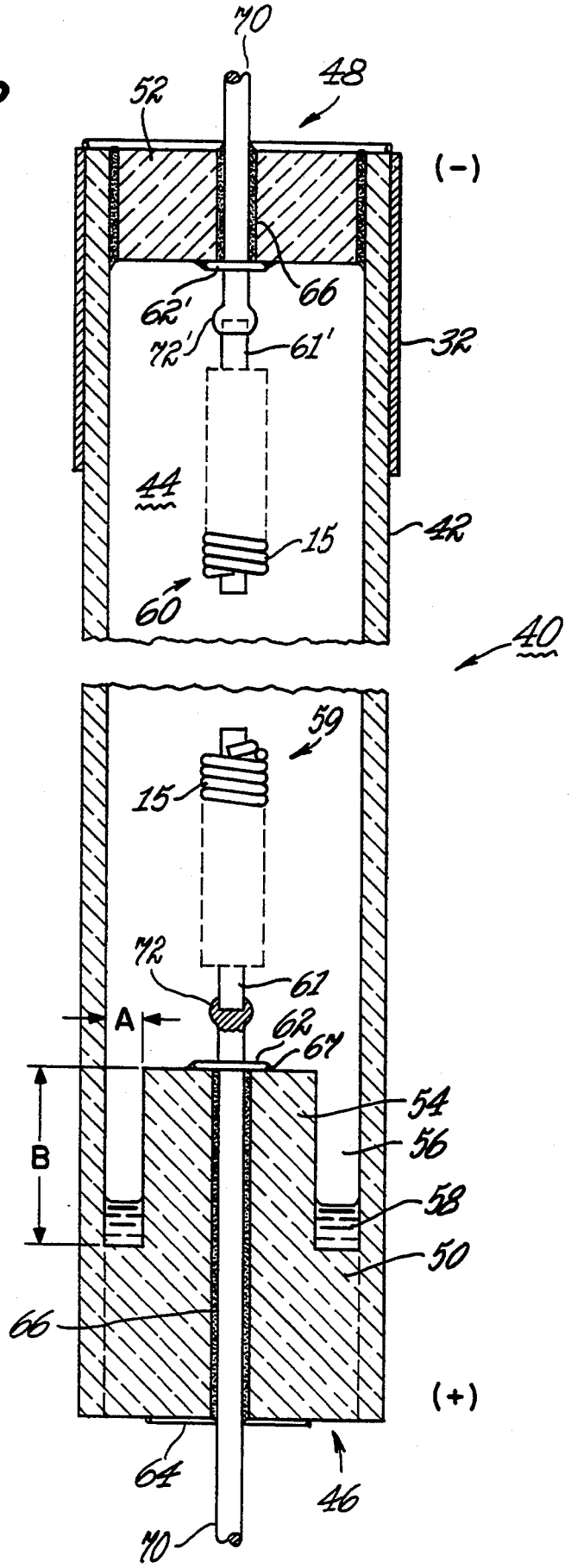
FIG. 2 is a sectional view of an HPS arc tube design useful in the present invention having an internal amalgam reservoir.

Turning now to FIG. 2, arc chamber assembly 48 is shown as comprising hollow ceramic arc tube 42 enclosing arc chamber cavity 44 within having anode and cathode end closures 46 and 48, respectively. Anode and cathode end plugs 50 and 52, respectively, are also made of ceramic such as polycrystalline alumina or single crystalline (sapphire) alumina as is known to those skilled in the art. Anode plug 50 includes a pedestal portion 54 extending up from the region of commonality with the wall of ceramic tube 42 and defining with the wall an annular chamber or compartment 56 for holding unvaporized excess sodium-mercury amalgam shown at 58. The anode and cathode inlead assemblies 59 and 60 include niobium inlead wire 70 and 70' to which anode 59 and cathode 60 are attached by weld knots 72 and 72'. Both the anode 59 and cathode 60 comprise a tungsten shank 61 and 61' having two layers of tungsten wire 14 coiled around it to retain an electron emissive material such as dibarium calcium tungstate in the interstices between turns as for anode 14 in FIG. 1(*c*). Niobium inlead wire is upset at 62 to provide a shoulder which serves to locate the anode and cathode with respect to the inner surface of the pedestal and plug, respectively. A cross wire 64 is spot welded to niobium inlead wire 10 to retain it in place and prevent it from falling out during sealing. A sealing frit or glass may be provided as a powder surrounding inlead wire 10 where it comes out of each plug or, preferably in the form of a washer of pressed powder which is threaded over the projecting portion of the wire. Upon heating, the frit melts, fills the aperture as illustrated at 66 and forms a small fillet 67 about the upset. Cathode end plug 52 is hermetically sealed to ceramic tube 42 by means of a suitable frit 21, whereas anode plug 66 is hermetically sealed to ceramic tube 42 by assembling plug 50 and tube 44 in the green state and then firing as taught in U.S. Pat. No. 3,026,210 and 4,868,457. An HPS arc chamber assembly of this type suitable for use in the present invention is disclosed in U.S. Pat. No. 4,868,457 the disclosures of which are incorporated herein by reference. Niobium metal foil 32 is wrapped around the cathode end of arc chamber assembly 40 in order to raise the temperature at the cathode end so that the temperature differential between the cathode end and the anode end is at least 50° C. and preferably at least 60° C.

The total pressure in the arc chamber of an HPS lamp is constant along the length of the chamber for both an AC or a DC operated lamp. However, because there are unionized vapors such as mercury and the inert starting gas present in the arc chamber in addition to the alkali metal vapor, and because in DC operation the cataphoretic effect pumps or drives ionized alkali metal toward the cathode end, a pressure gradient of the alkali metal is established along the length of the arc chamber between the anode and cathode end. The lowest value of the alkali metal pressure occurs at the anode end, and in the DC lamp of the invention it is determined by the coldest spot in the chamber which is located behind the tip of the anode as is shown in FIGS. 1 and 2. Any amalgam present in excess of that amount vaporized during lamp operation will be located as a condensed pool or reservoir at the coldest spot behind the tip of the anode. In a lamp of the construction shown in FIG. 1, the coldest spot will be in the niobium metal tube 19 projecting behind the anode and external of the ceramic tube 9. In a lamp of the construction illustrated in FIG. 2, the amalgam will be present behind the anode 59 in the cavity formed between the pedestal portion of the end 54 of the anode end plug and the inner wall of of the ceramic arc tube 42 and is shown as a pool 58. By DC operated is meant steady DC, pulsed DC or a combination of steady state and pulsed DC operation. In the latter case, a combination of steady state and pulsed DC, DC pulses of short duty cycle will be superimposed on a steady DC current in order to achieve a higher color temperature without substantially increasing the overall sodium pressure or the temperature of the ceramic arc discharge tube. Experiments have shown that cataphoretic pumping is generally greater for steady DC than pulsed DC at the same power input. The cataphoretic pumping or separation effect also increases as the mercury pressure and/or pressure of the inert starting gas normally employed in such lamps increases. In a DC operated HPS lamp wherein the alkali metal is sodium or primarily sodium, having less than 20 wt. % sodium in the amalgam of mercury and sodium makes it difficult to avoid color separation or relocation of the amalgam, and it also results in low luminous efficacy. Although there is no upper limit for the amount of sodium in the sodium-mercury amalgam present in a DC operated HPS lamp, and although increasing the concentration of sodium in the amalgam makes it easier to control and avoid the cataphoretic effect, lamp efficacy falls off as the amount of sodium in the amalgam exceeds 30 wt. %. Other alkali metals which may be used include lithium for a red-emitting lamp and cesium for an infrared-emitting lamp. Other metals may be added such as the ternary amalgam as described in U.S. Pat. No. 4,639,639 which includes indium, gallium or tin. This reduces the warm-up time and reduces the temperature dependence of the operating voltage, but exacerbates the cataphoretic effect. Plate 6(*b*) facing page 225 in "The High-Pressure Sodium Lamp" by deGroot and van Vliet (Philips Technical Library, 1966) is a photo of a DC operated HPS lamp containing sodium and mercury (and possibly a starting gas) which illustrates extreme cataphoretic separation between the sodium and the mercury. In the photograph one-third of the arc discharge emits an orange color and the other two-thirds emits a blue color with a line of separation between the orange and blue colors. The orange emission is from sodium atoms and the blue emission is from mercury. The starting gas does not participate in the visible light emission. The cataphoretic action of the DC operated HPS arc discharge lamp altered the vapor composition along the length of the arc tube to produce a sodium rich composition at the cathode end and a mercury rich composition at the anode end which resulted in total color separation. In the extreme case illustrated by the book, the electrical resistance per unit length of the blue discharge is greater than that of the orange discharge, so that the power per unit length dissipated within the mercury rich portion of the discharge is substantially greater than normal. This situation results in overheating and failure of the arc tube and/or seal at the anode end. Furthermore, the blue discharge emits only about half the lumens per watt of the normal sodium discharge. The present invention overcomes these problems by keeping the cathode end of the arc chamber at least 50° and preferably at least 60° C. higher than the anode end in order to maintain the amalgam location behind the tip of the anode, while keeping the cathode to anode alkali metal vapor pressure ratio below 5 during operation of the lamp by maintaining a CDP of less than 150. The temperature differential prevents condensation of the amalgam at the cathode end whereas the pressure ratio is driven by the CDP. It has been determined experimentally that the tendency for cataphoretic separation increases as the arc current increases, as the gap increases and as the bore diameter decreases. As set forth above, in a preferred embodiment the cataphoretic driving parameter (CDP), which is the product of the RMS arc current in amperes times the length of the arc gap in centimeters, divided by the square of the diameter of the arc tube bore measured in centimeters will have a value less than 150 and preferably less than 130. The temperature of the cathode end of the arc tube during operation of the lamp can be increased in a number of ways, perhaps the most facile of which are to wrap a suitable metal foils (such as niobium, tantalum, molybdenum, platinum and the like) around the cathode end of the arc chamber and, if necessary, shorten the length of the cathode. The temperature at the anode end of the arc chamber can be reduced by lengthening the electrode so that the coldest spot of the anode end of the chamber is further away from the arc discharge (FIG. 2) and/or by employing an external reservoir for the amalgam such as the niobium tube illustrated in FIG. 1. The outside surface of the niobium tube at the anode end may be toughened to dispel heat and a black, heat-emissive coating, such as graphite, also may be employed on both the anode end of the outside surface of the arc chamber and on the outer surface of the protruding niobium tube which contains the excess sodium amalgam. Employing these various methods can produce a temperature differential between the anode and cathode ends such that the cathode end is more than 100° C. hotter than the anode end.

Figure 3:
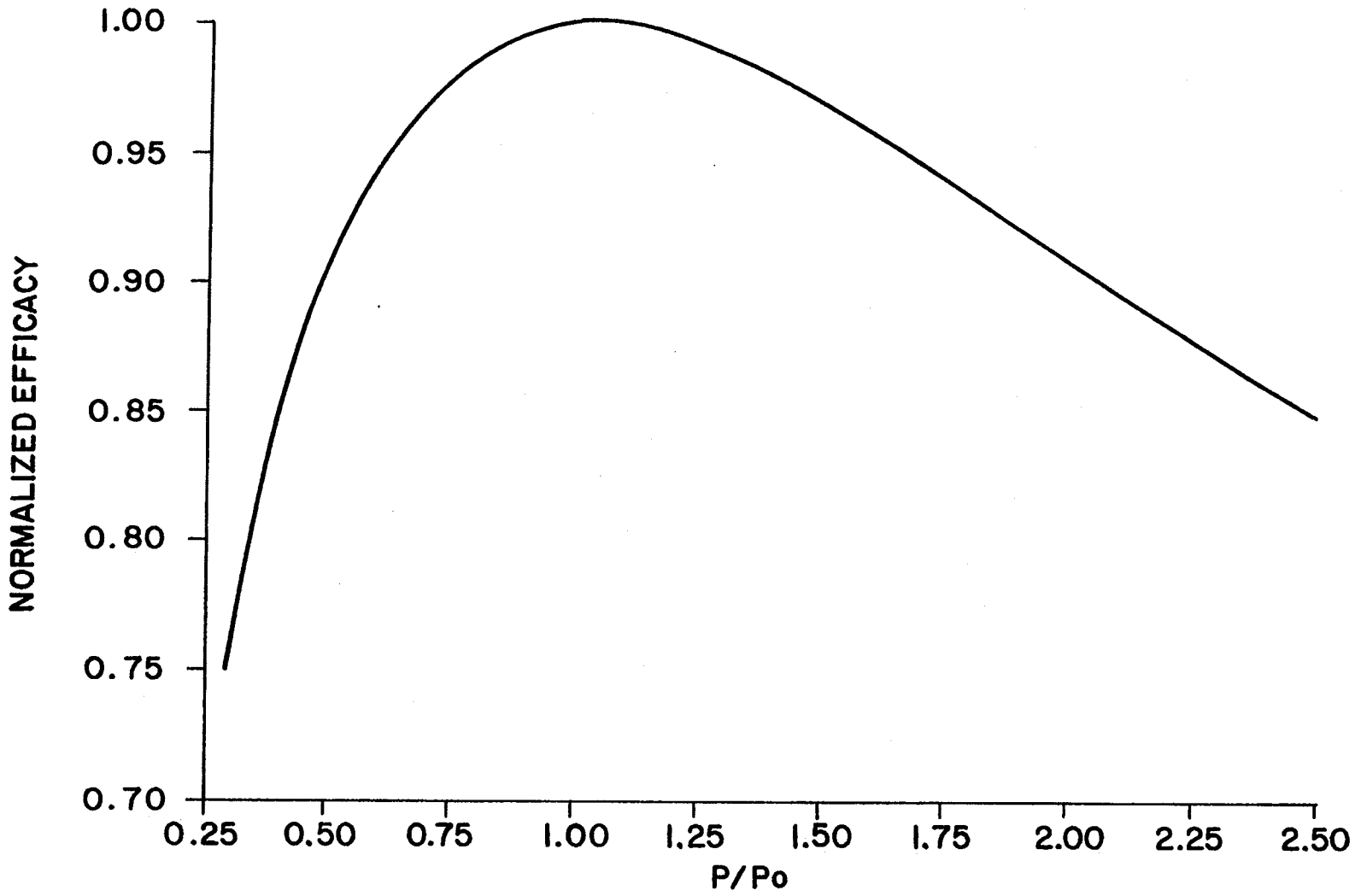
FIG. 3 graphically illustrates normalized efficacy for an HPS lamp as a function of the scaled sodium pressure.

FIG. 3 is a plot of normalized efficacy as a function of relative sodium pressure based on experimental data for various AC operated HPS lamps where the lamp power was held constant while the amalgam cold spot temperature was varied with an independent heater circuit. The efficacy data were collected as a function of E/Eo, the arc electric field in volts per centimeter of arc gap length relative to the electric field value Eo which produced the optimum lamp efficacy at the lamp power employed. The arc gap length was measured as the distance between the tips of the two electrodes. It has been determined that the relative arc electric field E/Eo is approximately equal to the two-thirds ($\frac{2}{3}$) power of the relative sodium pressure P/Po in such an AC arc tube. By relative sodium pressure is meant the actual sodium pressure, P, in the AC operated lamp divided by the optimum sodium pressure, Po, which yielded the greatest efficacy or lumens per watt output of the lamp. FIG. 3 illustrates how the efficacy drops off as the actual sodium pressure becomes less than or more than the optimum sodium pressure. In a DC operated lamp the sodium partial pressure will vary from the cathode end of the arc tube to the anode end of the arc tube with the sodium pressure being greatest at the cathode end of the arc tube. The total pressure, that is, the sum of the sodium, mercury, and starting gas pressures, remains constant throughout the length of the arc tube irrespective of AC operation or DC operation. If the ratio of the cathode (Pc) to anode (Pa) sodium pressure is 5, for example, then P/Po might be 0.5 at the anode end and 2.5 at the cathode. According to FIG. 3, the efficacy at the ends of the discharge will be about 85% of that in the mid-portion where the sodium pressure is more nearly optimum. Thus a DC-operated lamp will not be as efficient as AC, but the relative loss in efficiency can be minimized and color separation avoided by designing the lamp to keep Pc/Pa less than 5 by maintaining the CDP value below 150 and preferably below 130 and also by insuring that the cathode end is at least 50° C. and preferably 60° C. hotter than the anode end in order to prevent amalgam condensation at the cathode end, and to promote back-diffusion of the concentrated sodium vapor toward the anode end which has been depleted as a result of cataphoretic pumping toward the cathode end.

The invention will be further understood by reference to the examples below which, along with the foregoing, are intended to be illustrative, but non-limiting with respect to the practice of the invention.

EXAMPLES

In this experiment a Lucalox® polycrystalline alumina ceramic HPS arc tube having a 5.5 mm bore was constructed as shown in FIG. 1 with an outwardly protruding niobium tube. The arc chamber contained 25 mg of 25 wt. % sodium −75 wt. % mercury amalgam and 17 torr of xenon as a starting gas. The 25 mg of amalgam was in excess of the amount required to operate the lamp. The arc gap was 92 mm. This arc tube assembly was placed in an evacuated chamber. The temperature at each end of the arc tube was controlled by niobium wire wound around each end acting as heaters which permitted independent adjustment of the temperature at each end. The lamp was operated on steady DC at 382 watts, 109 volts and 3.5 amperes which corresponds to an electric field of 11.3 volts/cm and a wall loading of 23 watts/cm$^2$ when end losses are accounted for. With the coldest spot at the anode end measured as 629° C., it was found that sodium-enriched amalgam would start to condense at the cathode end at a temperature of 715° C. Thus, 86° C. was found to be the minimum temperature differential required to avoid amalgam condensation at the cathode end of the arc tube. The CDP value of IG/B$^2$ was 106. Sodium pressure at each end of the arc tube was determined from the temperature at each end and sodium vapor pressure curves. The cathode/anode sodium pressure ratio, Pc/Pa was determined to be 4.5.

In another experiment an HPS lamp was made as shown in FIG. 1 with the same type of arc tube having the same bore of 5.5 mm, but with only a 3.9 cm arc gap. As with the lamp described above, 25 mg of 25 wt. % sodium amalgam was used to insure the presence of excess amalgam and the lamp was operated on steady DC at 148 watts, 53 volts and 2.8 amperes to yield an electric field of 12.3 volts/cm and a wall loading of 20 watts/cm$^2$. Niobium foil was wrapped around the cathode end which resulted in a cathode temperature of 856° C. The coldest spot at the anode end was measured as 653° C. (at end of niobium tube amalgam reservoir protruding outside of the arc tube). Thus the cathode end was 203° C. hotter than the anode end during lamp operation and the possibility of amalgam condensation at the cathode end was thereby eliminated. The cathode/anode sodium pressure ratio was 2.0. This was determined using the spectroscopic method employing the wavelength separation $\Delta\lambda$ between the maxima of the self-reversed sodium D− lines in the sodium arc discharge emission spectrum at each arc tube end. This method is known to those skilled in the art and may be found, for example, in section 3.2.1 "Sodium Vapour Pressure" beginning on page 84 of the book by deGroot and van Vliet referred to above. The CDP value for the lamp was 36.

Figure 4:
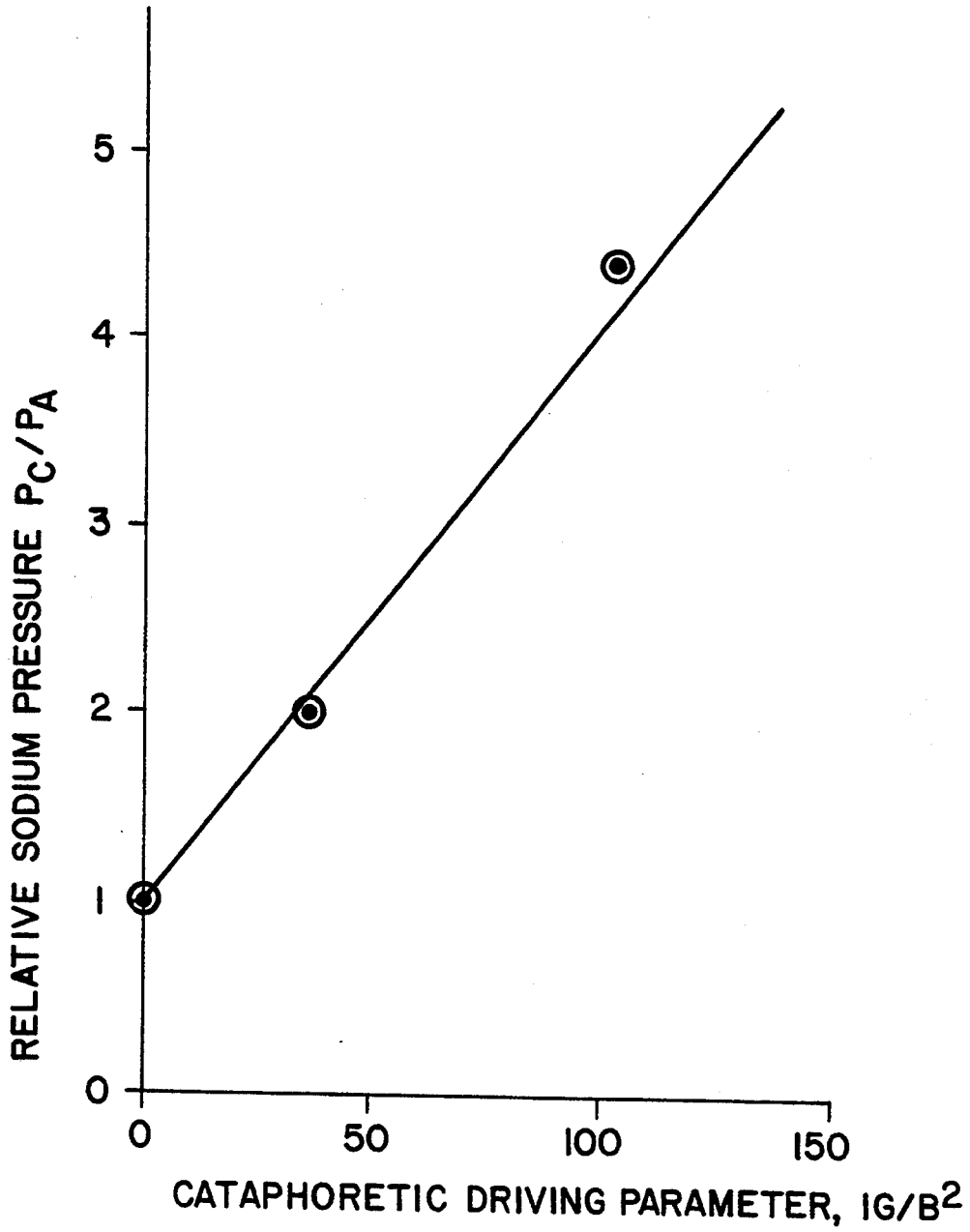
FIG. 4 is a plot of the ratio of cathode end sodium pressure to anode end sodium pressure as a function of the cataphoretic driving parameter for a DC operated HPS lamp.

FIG. 4 is a plot of the relative sodium pressure ratio Pc/Pa as a function of the cataphoretic driving parameter, CDP, using the data generated in these experiments. Another known data point has X− and Y− coordinates of 0 and 1, respectively, which corresponds to the case of an AC lamp, where there is no net cataphoretic driving force, and the sodium pressures at the cathode and anode ends are equal. The three points are seen to fit a straight line. FIG. 4 shows that to obtain values of Pc/Pa less than 5 in order to maintain high lamp efficacy and to avoid problems associated with color separation and arc tube overheating, the CDP must be below 150.

What is claimed is:

1. A DC operated alkali metal vapor arc discharge lamp comprising an elongated, light-transmissive arc chamber containing an amalgam of alkali metal and mercury and a starting gas and having an electrode sealed in each end to form an anode end and a cathode end, with the temperature at said cathode end at least 50° C. higher than the temperature at said anode end during operation of said lamp and a cathode to anode alkali metal pressure ratio no greater than 5 during operation of said lamp.

2. The lamp of claim 1 wherein said mercury amalgam contains at least 20 wt. % alkali metal.

3. The lamp of claim 2 having an excess of said amalgam present during operation of said lamp located behind a tip of said anode end.

4. The lamp of claim 3 having a CDP value of less than 150.

5. The lamp of claim 4 wherein said cathode end temperature is at least 60° higher than said anode end temperature during operation of said lamp.

6. The lamp of claim 5 having a CDP value of less than 130.

7. The lamp of claim 6 wherein said arc chamber is ceramic.

8. The lamp of claim 7 wherein said ceramic comprises polycrystalline alumina.

9. The lamp of claim 7 wherein said ceramic comprises sapphire.

10. A DC operated HPS metal vapor arc discharge lamp comprising an elongated, light-transmissive arc chamber containing an amalgam of mercury and sodium having a sodium content of at least 20 wt % along with a starting gas and having an electrode sealed in each end to form an anode end and a cathode end with the temperature of said cathode end at least 50° C. higher than the temperature at said anode end during operation of said lamp and a cathode to anode sodium metal pressure ratio no greater than 5 during operation of said lamp.

11. The lamp of claim 10 having an excess of said amalgam present behind a tip of said anode end during operation.

12. The lamp of claim 11 having a CDP value of less than 150.

13. The lamp of claim 12 having a CDP value of less than 130 and wherein said cathode end temperature is at least 60° C. hotter than said anode end.

14. The lamp of claim 13 wherein said arc chamber is ceramic.

15. A DC operated HPS metal vapor arc discharge lamp comprising a linear, light-transmissive alumina arc chamber having an electrode sealed in each end to form an anode end and a cathode end and containing a starting gas and an amalgam of mercury and sodium having a sodium content of at least 20 wt. %, with said cathode end at least 50° C. higher than said anode end during operation of said lamp, a cathode to anode sodium metal pressure ratio no greater than 5 during operation of said lamp and having a CDP value of less than 150.

* * * * *